US007766642B2

(12) United States Patent
Trebilcock

(10) Patent No.: US 7,766,642 B2
(45) Date of Patent: Aug. 3, 2010

(54) PORTABLE CONDUIT BENDING FRAME ASSEMBLY AND METHOD OF USE THEREOF

(76) Inventor: Herbert A. Trebilcock, 242 43d St., S.E., Kentwood, MI (US) 49548

( * ) Notice: Subject to any disclaimer, the term of this patent is extended or adjusted under 35 U.S.C. 154(b) by 473 days.

(21) Appl. No.: 11/559,327

(22) Filed: Nov. 13, 2006

(65) Prior Publication Data

US 2008/0110225 A1 May 15, 2008

(51) Int. Cl.
*B28B 21/98* (2006.01)
*B28B 21/92* (2006.01)

(52) U.S. Cl. ..... 425/403; 425/392; 425/393

(58) Field of Classification Search ..... 425/393, 425/403

See application file for complete search history.

(56) References Cited

U.S. PATENT DOCUMENTS 1,610,196 A * 12/1926 Blaisdell ..... 72/31.05
2,349,525 A * 5/1944 St Clair ..... 72/31.05
3,184,796 A * 5/1965 Southcott et al. ..... 425/384
3,546,917 A * 12/1970 Gardner et al. ..... 72/369
3,753,635 A 8/1973 Barnett
3,776,539 A 12/1973 Curtis, et al.
3,939,764 A 2/1976 McCormack
4,255,378 A 3/1981 Miller et al.
5,125,825 A 6/1992 Janosco
5,200,124 A 4/1993 Bowkett
D416,566 S 11/1999 Perez
6,257,880 B1 7/2001 Hirayama
6,561,797 B1 * 5/2003 Johnson ..... 432/225

* cited by examiner

*Primary Examiner*—Philip C Tucker
*Assistant Examiner*—Alison Hindenlang
(74) *Attorney, Agent, or Firm*—Barley Snyder LLC

(57) ABSTRACT

A portable conduit bending frame assembly comprises a support member having a conduit support surface extending substantially perpendicular to a top surface of the support member. A shoe is attached to the top surface of the support member. The shoe has a first alignment surface extending substantially perpendicular to a second alignment surface. A conduit bending surface extends between the first and second alignment surfaces and has a substantially arcuate configuration. The conduit bending surface faces the conduit support surface. A heating device is arranged proximate the conduit support surface for heating a conduit prior to bending the conduit at least partially about the conduit bending surface.

18 Claims, 9 Drawing Sheets

FIG. 4
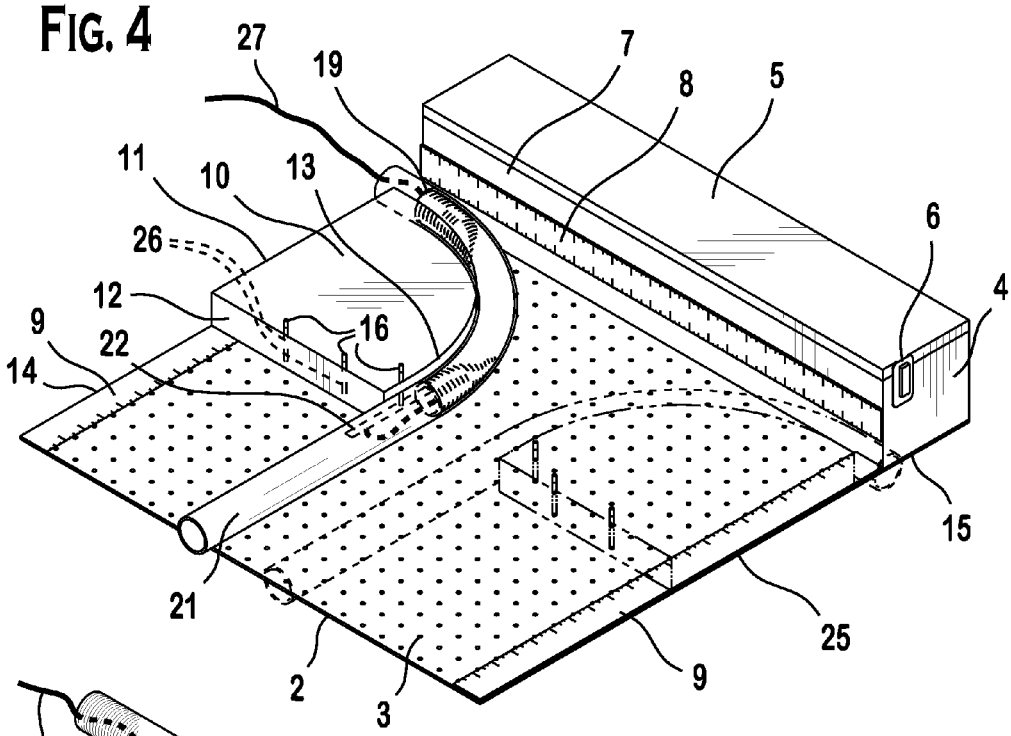
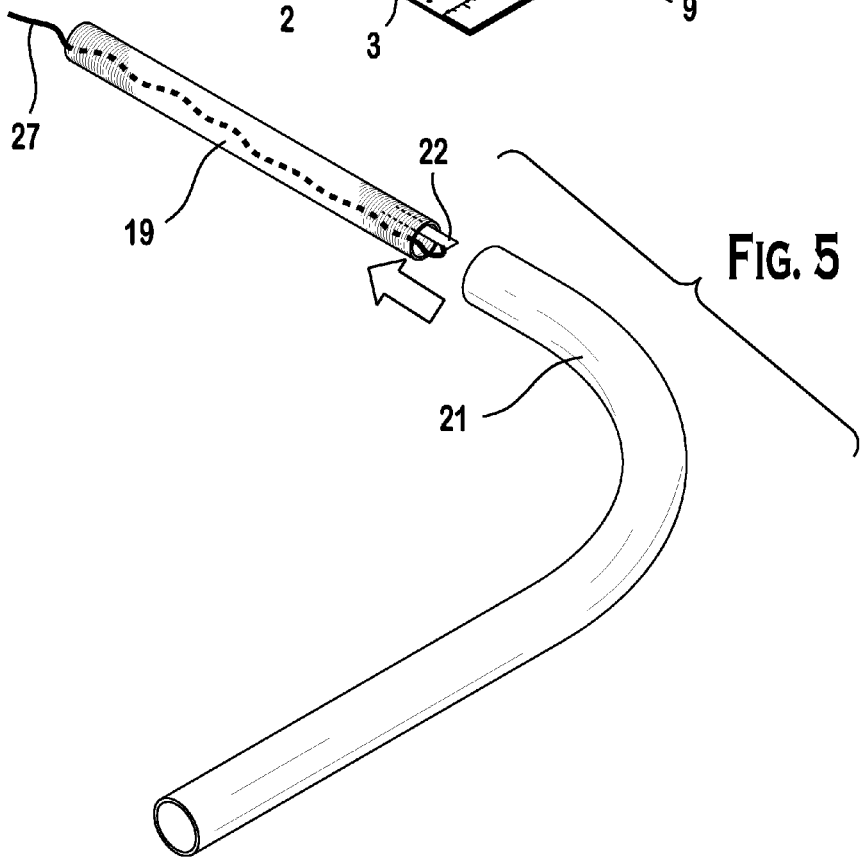
FIG. 5

PORTABLE CONDUIT BENDING FRAME ASSEMBLY AND METHOD OF USE THEREOF

FIELD OF THE INVENTION

The invention relates to a portable conduit bending frame assembly and method of bending a conduit utilizing the same.

BACKGROUND OF THE INVENTION

Conduits requiring a plurality of bends or offsets are preferably fabricated, formed, or bent to a desired configuration at the site where the conduits are to be installed. In order to fabricate the conduit on site, several pre-formed or pre-bent conduit components are fixed together with couplings to form a desired configuration. Because several conduit components having different bends or offsets must be brought to the site in order to fabricate the conduit, this type of fabrication requires transporting a large amount of conduit components to every site. Additionally, the couplings add to the final cost of the conduit. Alternatively, to form or bend the conduit on site, the conduit must be heated to a temperature where the conduit is capable of being formed or bent to a desired configuration. Conventional methods for heating the conduit, however, are bulky and inefficient. It is therefore desirable to provide a portable conduit bending frame assembly that is easy to transport and operate that can economically heat and form or bend a conduit to a desired configuration.

BRIEF SUMMARY OF THE INVENTION

The invention provides a portable conduit bending frame assembly comprising a support member having a conduit support surface extending substantially perpendicular to a top surface of the support member. A shoe is attached to the top surface of the support member. The shoe has a first alignment surface extending substantially perpendicular to a second alignment surface. A conduit bending surface extends between the first and second alignment surfaces and has a substantially arcuate configuration. The conduit bending surface faces the conduit support surface. A heating device is arranged proximate the conduit support surface for heating a conduit prior to bending the conduit at least partially about the conduit bending surface.

The invention further provides a portable conduit bending frame assembly comprising a support member having a conduit support surface extending substantially perpendicular to a top surface of the support member. A heating device heats the conduit prior to bending the conduit. A shoe is attached to the top surface of the support member. The shoe has a first alignment surface extending substantially perpendicular to a second alignment surface. A conduit bending surface extends between the first and second alignment surfaces and has a substantially arcuate configuration. A conduit is sandwiched between the conduit bending surface and the conduit support surface. The conduit is at least partially bent about the conduit bending surface.

The invention still further provides a method of bending a conduit. The method comprises the steps of providing a support member having a conduit support surface extending substantially perpendicular to a top surface thereof; heating a conduit until it is bendable with a heating device; attaching a shoe to the top surface of the support member such that the conduit is sandwiched between a substantially arcuate bending surface of the shoe and the conduit support surface; and bending the conduit about the conduit bending surface until the conduit at least partially concentrically embraces the conduit bending surface.

BRIEF DESCRIPTION OF THE DRAWINGS

FIG. 4 is a perspective view of a third step in the method of bending the conduit using the portable conduit bending frame assembly of FIG. 1.

FIG. 5 is a perspective view of a fourth step in the method of bending the conduit using the portable conduit bending frame assembly of FIG. 1.

DETAILED DESCRIPTION OF THE INVENTION

Figure 1:
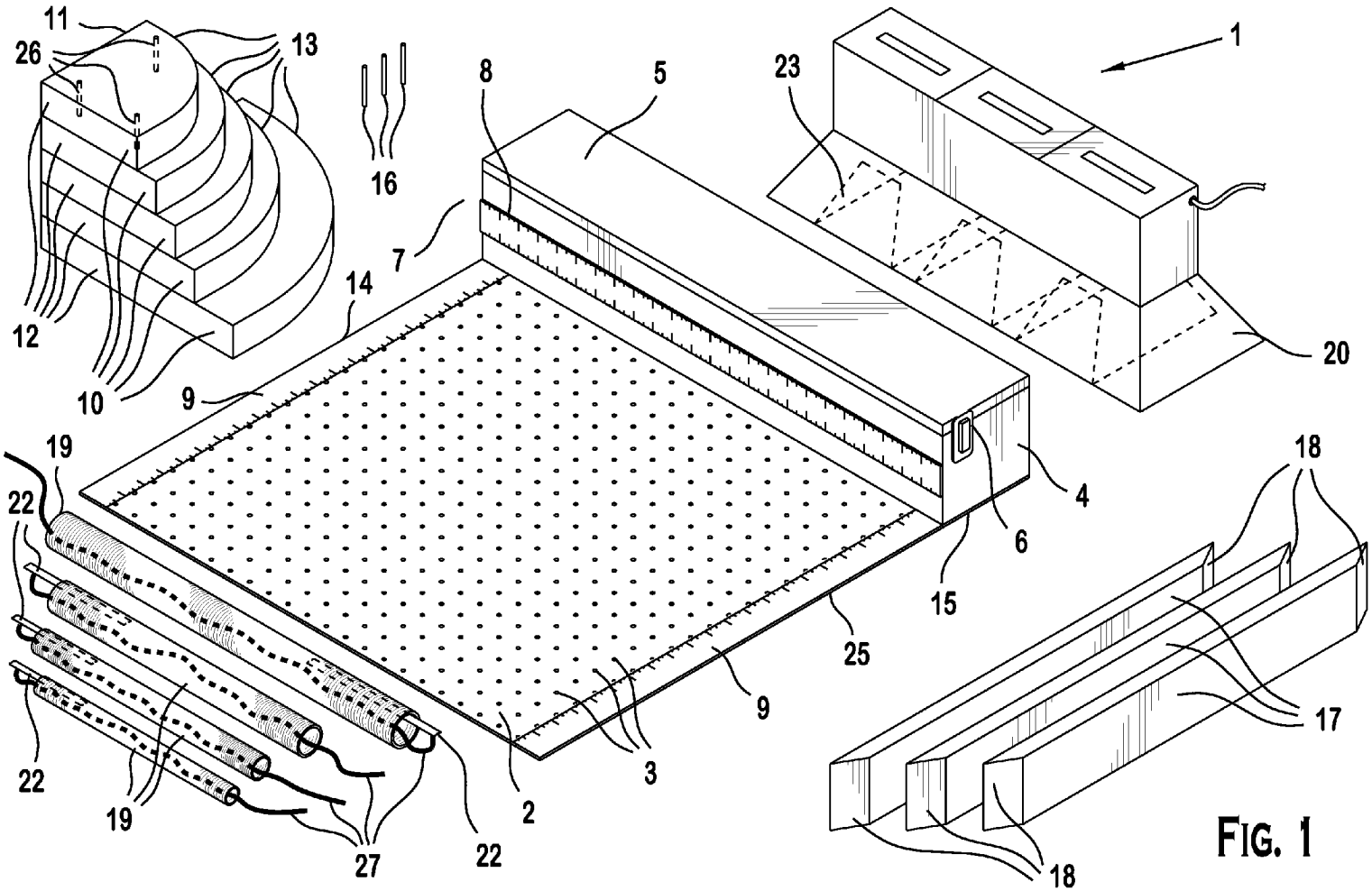
FIG. 1 is a top perspective view of a portable conduit bending frame assembly according to a first embodiment of the invention.

FIGS. 1-6 show a portable conduit bending frame assembly 1 according to a first embodiment of the invention. As shown in FIG. 1, the portable conduit bending frame assembly 1 includes a support member 2, a storage container 4, a plurality of shoes 10, a plurality of shoe attachment members 16, a plurality of shims 17, a plurality of springs 19, and a heating device 20. Each of the individual elements of the bending frame assembly 1 will now be described in greater detail.

As shown in FIG. 1, the support member 2 is substantially rectangular and is provided with a plurality of apertures 3. The support member 2 may be formed, for example, from a non-conductive material, such as a mineral wool peg board, or a heat tolerant material, such as aluminum. The support member 2 includes first and second alignment ends 14, 25, respectively, and a conduit receiving end 15. The first and second alignment ends 14, 25 extend substantially perpendicular to the conduit receiving end 15. The first and second alignment ends 14, 25 extend in a direction of length of the support member 2, and the conduit receiving end 15 extends in a direction of width of the support member 2. The length of the support member 2 may be, for example, about 21 inches and the width of the support member 2 may be, for example, about 24 inches.

As shown in FIG. 1, the storage container 4 is mounted to the conduit receiving end 15 of the support member 2. The storage container 4 is substantially rectangular in shape and includes a cover 5 rotatably mounted thereto. The storage container 4 may, for example, have a width of about 5.5 inches and a length substantially similar to the width of the support member 2. A locking mechanism 6 secures the cover 5 to the storage container 4 in a closed position. One side of the storage container 4 is formed as a conduit support surface 7. The conduit support surface 7 extends the approximate length of the support member 2 and is positioned substantially parallel thereto. The storage container 4 is provided with a handle (not shown) that facilitates carrying the support member 2.

As shown in FIG. 1, a first conduit measuring device 8 is provided on the conduit support surface 7. The first conduit measuring device 8 extends the approximate width of the support member 2. The first conduit measuring device 8 may have, for example, units of measurement that measure from the first alignment end 14 to the second alignment end 25 and/or from the second alignment end 25 to the first alignment end 14. Second conduit measuring devices 9 extend substantially perpendicular to the first conduit measuring device 8 along the first and second alignment ends 14, 25. The second conduit measuring devices 9 extend the approximate length of the support member 2. The first and second conduit measuring devices 8, 9 may be, for example, provided with units of measurement, such as notches, metric units, English units, etc.

As shown in FIG. 1, each of the shoes 10 has first and second alignment surface 11, 12, respectively. The first alignment surface 11 extends substantially perpendicular to the second alignment surface 12. A conduit bending surface 13 extends between the first surface 11 and the second surface 13. The conduit bending surface 13 has a substantially arcuate configuration. The first and second alignment surfaces 11, 12 and the conduit bending surface 13 are formed to have a desired dimension. The substantially arcuate configuration of the conduit bending surface 13 may be, for example, the minimum arcuate configuration specified by the national electric code. For example, the shoes 10 may have a radius of between about 5 inches and 17 inches, however, other dimensions are possible. In the illustrated embodiment, a plurality of the shoes 10 are provided, which each have a different dimension.

Shoe attachment member receiving openings 26 are formed in the shoes 10 and extend from a bottom surface to a top surface thereof. The shoe attachment member receiving openings 26 are arranged a distance from the first and second alignment surfaces 11, 12 and the conduit bending surface 13 of the shoe 10. The shoe attachment member receiving openings 26 correspond to the apertures 3 of the support member 2. Each of the shoes 10 may be formed with a plurality of weight reducing openings (not shown) that extend between the top surface and the bottom surface of the shoes 10. The weight reducing openings (not shown) provide for easier handling when positioning and removing the shoes 10. The shoes 10 may be formed, for example, from wood, aluminum, fiberglass, etc.

As shown in FIG. 1, the shoe attachment members 16 are substantially cylindrical and correspond to the shoe attachment member receiving openings 26 of the shoes 10 and the apertures 3 of the support member 2. The shoe attachment members 16 have a length such that a portion of the shoe attachment members 16 extends from the top and bottom surface of the shoes 10. It will be appreciated by those skilled in the art that the shoe attachment members 16 may alternatively be formed integrally with the shoes 10 or the support member 2. The shoe attachment members 16 may be formed, for example, from wood, aluminum, fiberglass, or a heat tolerant material.

As shown in FIG. 1, the shims 17 are substantially rectangular in shape and have at least one beveled end 18. The beveled ends 18 are formed to have a desired dimension. In the illustrated embodiment, a plurality of the shims 17 are provided, which each have a different thickness and beveled ends of different angular dimensions. The shims 17 may, for example, have a thickness of between about ⅛ inch and ¾ inch, however other dimensions are possible. The shims 17 may be formed, for example, from wood, aluminum, fiberglass, sheet felt, etc.

As shown in FIG. 1, the springs 19 are substantially elongated in shape and are formed to have an external dimension and length. In the illustrated embodiment, a plurality of the springs 19 are provided, which each have a different external dimension and length. A tape 22 may be woven through a first end of the spring 19. A pulling member 27, such as steel fish tape, may be attached to the tape 22. In the illustrated embodiment, the pulling member 27 is fed through the spring 19 such that the pulling member 27 extends from the second end of the spring 19. Alternatively, the pulling member 27 may be directly attached to the first end of the spring 19. It will be appreciated by those skilled in the art that structures other than springs 19 may also be provided.

As shown in FIG. 1, the heating device 20 is substantially rectangular in shape and has a length substantially corresponding to the length of the support member 2. The heating device 20 is provided with a plurality of radiation elements 23 that radiate heat toward a heat emitting surface of the heating device 20. The radiation elements 23 may be, for example, a plurality of 500 Watt halogen heat strip bulbs. It will be appreciated by those skilled in the art, however, that the wattage of the halogen heat strip bulbs may vary depending of the desired speed of heating. The radiation elements 23 may also be individually controlled. A metal guard (not shown) may be provided between the radiation elements 23 and the heat emitting surface of the heating device 20. The heating device 20 may be any of a variety of conventional heating devices that is portable and is capable of radiating heat.

A method of bending a conduit 21 using the portable conduit bending frame assembly 1 according to the first embodiment of the invention will now be described with reference to FIGS. 2-6. It will be appreciated by those skilled in the art that the conduit 21 may include a pipe or other tubular member formed, for example, from a non-metallic material, such as a schedule 40 pipe, water conduit, elect conduit, etc.

Figure 2:
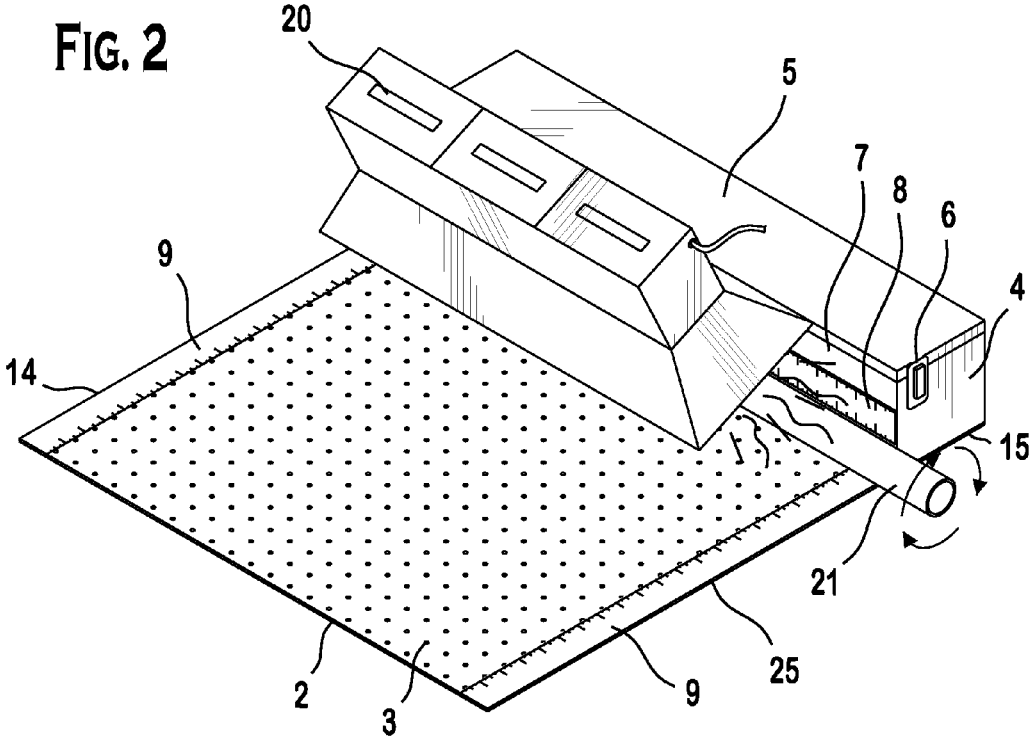
FIG. 2 is a perspective view of a first step in a method of bending a conduit using the portable conduit bending frame assembly of FIG. 1.

As shown in FIG. 2, one of the springs 19 is inserted into the conduit 21 such that the pulling member 27 protrudes from an end of the conduit 21 opposite from the tape 22. A lubricant (not shown), such as liquid soap or a non-stick spray, may be applied to the spring 19 and/or the conduit 21 before insertion of the spring 19 into the conduit 21. The external dimension of the spring 19 substantially corresponds to an internal dimension of the conduit 21. The conduit 21 is positioned on the conduit receiving end 15 of the support member 2 against the support surface 7 of the storage container 4 such that the conduit 21 extends in the direction of length of the support member 2. The heat emitting surface of the heating device 20 is positioned proximate the conduit 21 such that the radiation elements 23 radiate heat toward the conduit 21. The metal guard (not shown) of the heating device 20 may optionally be positioned such that the metal guard (not shown) is in contact with the conduit 21. As the conduit 21 is heated, the conduit 21 is periodically rotated in a direction of the arrows shown in FIG. 2 until the conduit 21 is heated to a temperature where it is substantially rubbery and/or capable of being bent with no or minimal resistance. Because the spring 19 is provided inside the conduit 21, the spring 19, which conducts heat, contributes to heating the conduit 21. Once the conduit 21 has been heated, the heating device 20 is removed from the support member 2.

Figure 3:
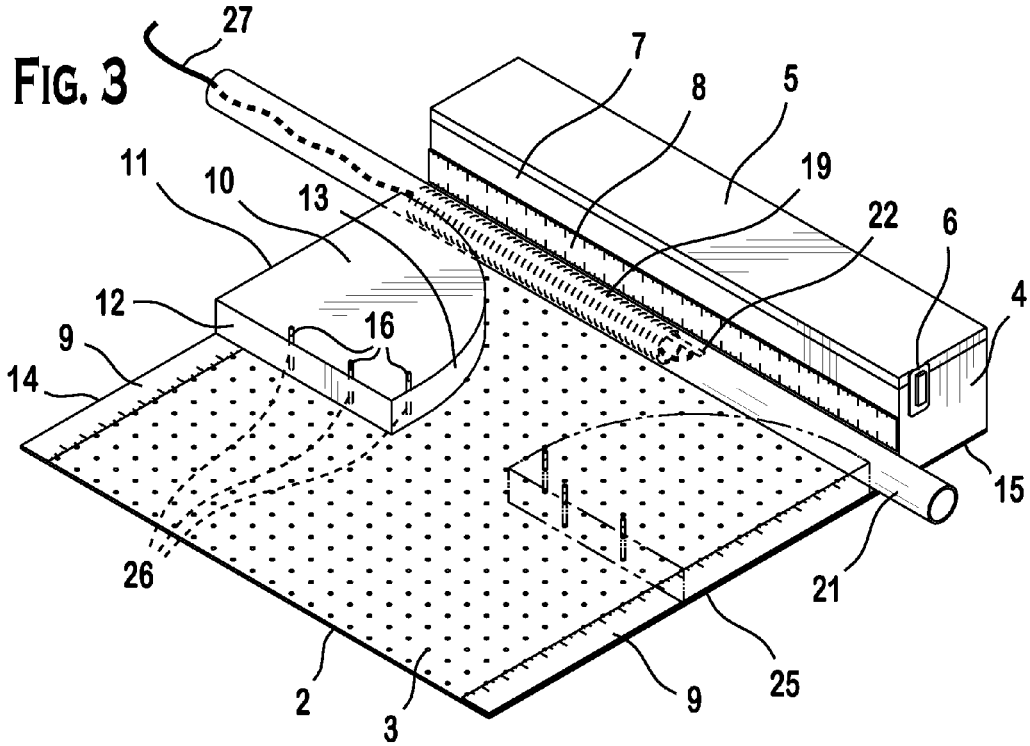
FIG. 3 is a perspective view of a second step in the method of bending the conduit using the portable conduit bending frame assembly of FIG. 1.

As shown in FIG. 3, at least one of the shoes 10 is attached to the support member 2. The shoe attachment members 16 are inserted into a plurality of the apertures 3 of the support member 2. The shoe 10 is attached to the support member 2 by aligning the first alignment surface 11 of the shoe 10 substantially parallel to the first alignment end 14 of the support member 2 such that the conduit 21 is sandwiched between the conduit bending surface 13 of the shoe 10 and the support surface 7 of the storage container 4. Alternatively, the shoe 10 may be attached to the support member 2 by aligning the first alignment surface 11 of the shoe 10 substantially parallel to the second alignment end 25 of the support member 2 such that the conduit 21 is sandwiched between the conduit bending surface 13 of the shoe 10 and the support surface 7 of the storage container 4, as shown in phantom in FIG. 3. The shoe attachment members 16 are received in the shoe attachment member receiving openings 26 of the shoe 10 to fix the shoe 10 relative to the support member 2.

As shown in FIG. 4, an end of the conduit 21 positioned farthest from the shoe 10 is pulled away from the support surface 7 such that the conduit 21 is bent about the conduit bending surface 13 with no or minimal resistance. The conduit 21 is bent until the conduit 21 concentrically embraces the substantially arcuate configuration of the conduit bending surface 13 of the shoe 10. Because the spring 19 is provided inside the conduit 21, the spring 19 prevents the internal dimension of the conduit 21 from constricting or deforming when the conduit 21 is bent about the conduit bending surface 13 of the shoe 10. Once the conduit 21 is bent to the desired configuration, the conduit 21 is allowed to cool and is then removed from the support member 2.

The spring 19 is removed from the conduit 21 by pulling on the pulling member 27 protruding from the end of the conduit 21, as shown in FIG. 5. Because the tape 22 is attached to the first end of the spring 19 and the pulling member 27, which is attached to the tape 22, extends from the second end of the spring 19, the spring 19 is prevented from stretching when the spring 19 is pulled from the conduit 21.

Figure 6:
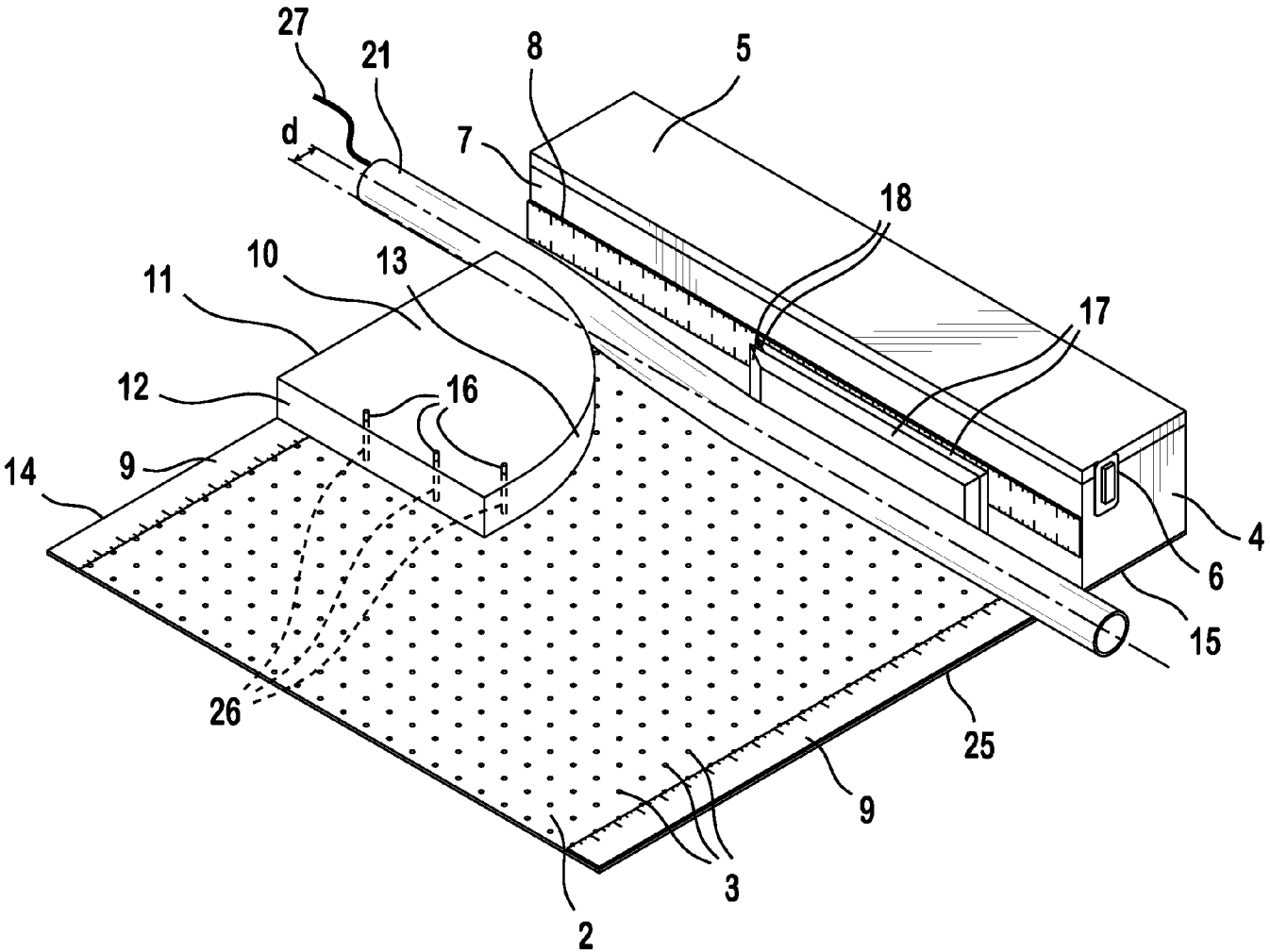
FIG. 6 is a perspective view of a second method of bending the conduit using the portable conduit bending frame assembly of FIG. 1.

FIG. 6 shows a second method of bending the conduit 21. As shown in FIG. 6, after the conduit 21 is heated to a temperature where it is substantially rubbery and/or capable of being bent with no or minimal resistance, at least one of the shims 17 may be positioned substantially parallel to and against the support surface 7 of the storage container 4 such that the beveled edges 18 extend in a direction of a desired offset d in the conduit 21. In the illustrated embodiment two of the shims 17 are positioned substantially parallel to and against the support surface 7 of the storage container 4. The conduit 21 is re-positioned against the support surface 7 such that the conduit 21 extends in the direction of width of the support member 2 and is positioned against the shims 17.

The shoe 10 is attached to the support member 2 by aligning the first alignment surface 11 of the shoe 10 substantially parallel to the first alignment end 14 of the support member 2 such that the conduit 21 is sandwiched between the conduit bending surface 13 of the shoe 10 and the support surface 7. The shoe attachment members 16 are received in the shoe attachment member receiving openings 26 of the shoe 10 to fix the shoe 10 relative to the support member 2. As a result of the conduit 21 being partially bent about the conduit bending surface 13 and engaging with the beveled edges 18 of the shims 17, the offset d is formed in the conduit 21.

Alternatively, at least one of the shims 17 may be positioned against the support surface 7 and substantially above the shoe 10. The conduit 21 is positioned between the conduit bending surface 13 of the shoe 10 and the shim 17. The conduit 21 is then bent about the bending surface 13 to form a bend in the conduit 21 when the shoe 10 provided to bend the conduit 21 is configured for a conduit having a larger diameter than the diameter of the conduit 21 desired to be bent. As a result, each of the shoes 10 can be used to bend the conduits 21 regardless of their diameters.

Although the conduit 21 is only illustrated as being formed with a single bend or offset d, it will be appreciated by those skilled in the art that the conduit 21 may be formed to have a plurality of bends and/or offsets d. Additionally, because the first conduit measuring device 8 may have, for example, units of measurement that measure from the first alignment end 14 to the second alignment end 25 and from the second alignment end 25 to the first alignment end 14, the conduit 21 may be easily arranged on the support member 2 to accommodate the direction of the desired subsequent bends and/or offsets d in view of the previously made bends and/or offsets d in the conduit 21.

After use, the shoes 10, the shoe attachment members 16, the shims 17, and the plurality of springs 19 may be stored in the storage container 4.

Figure 7:
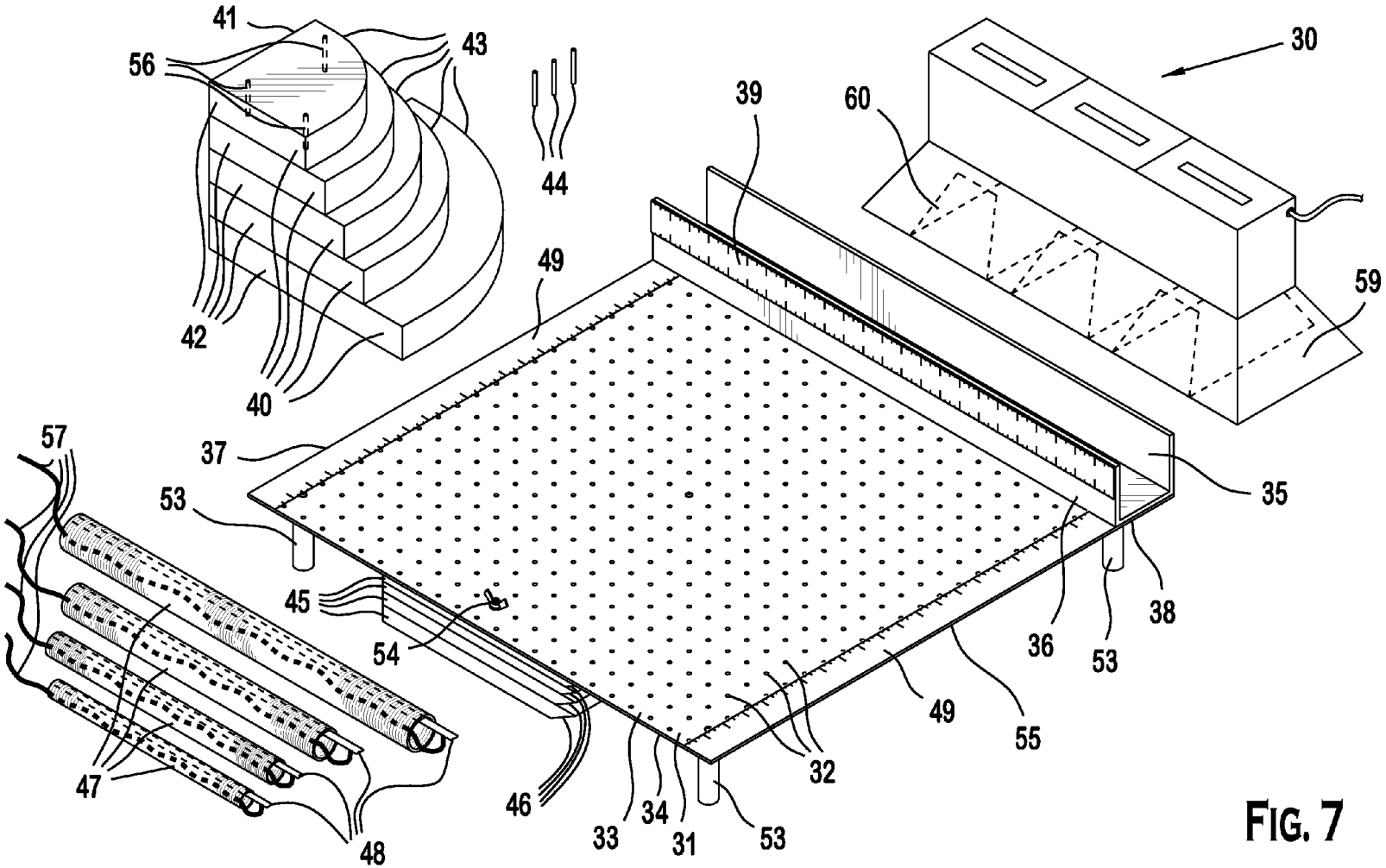
FIG. 7 is a top perspective view of a portable conduit bending frame assembly according to a second embodiment of the invention.
Figure 8:
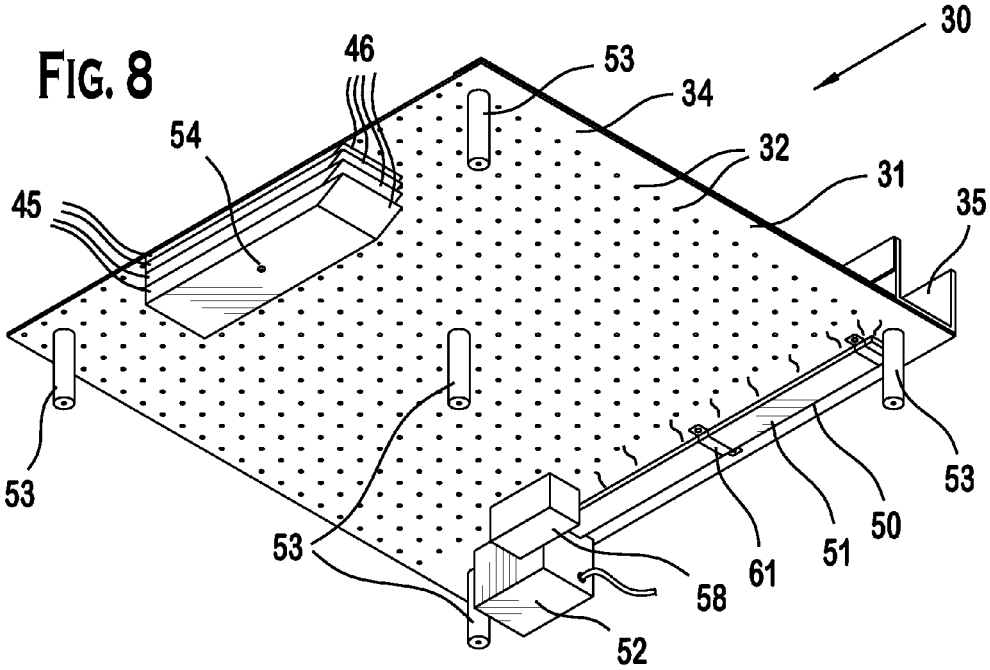
FIG. 8 is a bottom perspective view of the portable conduit bending frame assembly of FIG. 7.

FIGS. 7-12 show a portable conduit bending frame assembly 30 according to a second embodiment of the invention. As shown in FIGS. 7-8, the portable conduit bending frame assembly 30 includes a support member 31, a conduit holder 35, a plurality of shoes 40, a plurality of shoe attachment members 44, a plurality of shims 45, a plurality of springs 47, a pre-heating device 50, and a heating device 59. Each of the individual elements of the bending frame assembly 30 will now be described in greater detail.

As shown in FIG. 7, the support member 31 is substantially rectangular and is provided with a plurality of apertures 32. The support member 31 may be formed, for example, from a conductive material, such as aluminum, aluminum cast, or plate. The support member 31 includes a top surface 33, a bottom surface 34, first and second alignment ends 37, 55, respectively, and a conduit receiving end 38. The first and second alignment ends 37, 55 extend substantially perpendicular to the conduit receiving end 38. The first and second alignment ends 37, 55 extend in a direction of length of the support member 31, and the conduit receiving end 38 extends in a direction of width of the support member 31. The length of the support member 31 may be, for example, about 24 inches and the width of the support member 31 may be, for example, about 24 inches. Support legs 53 extend from the bottom surface 34 of the support member 31, as shown in FIG. 8.

As shown in FIG. 7, the conduit holder 35 is mounted to the top surface 33 of the conduit receiving end 38 of the support member 31. The conduit holder 35 is substantially U-shaped and extends the approximate width of the support member 31. One side of the conduit holder 35 is formed as a conduit support surface 36. The conduit support surface 36 extends the approximate length of the support member 31 and is positioned substantially parallel thereto. The conduit holder 35 may be formed, for example, from a conductive material, such as aluminum.

As shown in FIG. 7, a first conduit measuring device 39 is provided on the conduit support surface 36. The first conduit measuring device 39 extends the approximate width of the support member 31. The first conduit measuring device 39 may have, for example, units of measurement that measure from the first alignment end 37 to the second alignment end 55 and/or from the second alignment end 55 to the first alignment end 37. Second conduit measuring devices 49 extend substantially perpendicular to the first conduit measuring device 39 along an edge of the support member 31 along the first and second alignment ends 37, 55. The second conduit measuring devices 49 extend the approximate length of the support member 31. The first and second conduit measuring devices 39, 49 may be, for example, be provided with units if measurement, such as notches, metric units, English units, etc.

As shown in FIG. 7, each of the shoes 40 has first and second alignment surface 41, 42, respectively. The first alignment surface 41 extends substantially perpendicular to the second alignment surface 42. A conduit bending surface 43 extends between the first surface 41 and the second surface 43. The conduit bending surface 43 has a substantially arcuate configuration. The first and second alignment surfaces 41, 42 and the conduit bending surface 43 are formed to have a desired dimension. The substantially arcuate configuration of the conduit bending surface 43 may be, for example, the minimum arcuate configuration specified by the national electric code. For example, the shoes 40 may have a radius of between about 5 inches and 17 inches, however, other dimensions are possible. In the illustrated embodiment, a plurality of the shoes 40 are provided, which each have a different dimension.

Shoe attachment member receiving openings 56 are formed in the shoes 40 and extend from a bottom surface to a top surface thereof. The shoe attachment member receiving openings 56 are arranged a distance from the first and second alignment surfaces 41, 42 and the conduit bending surface 43 of the shoe 10. The shoe attachment member receiving openings 56 correspond to the apertures 32 of the support member 31. Each of the shoes 40 may be formed with a plurality of weight reducing openings (not shown) that extend between the top surface and the bottom surface of the shoes 40. The weight reducing openings (not shown) provide for easier handling when positioning and removing the shoes 10. The shoes 40 may be formed, for example, from wood, aluminum, fiberglass, etc.

As shown in FIG. 7, the shoe attachment members 44 are substantially cylindrical and correspond to the shoe attachment member receiving openings 56 of the shoes 40 and the apertures 32 of the support member 31. The shoe attachment members 44 have a length such that a portion of the shoe attachment members 44 extends from the top and the bottom surface of the shoes 40. It will be appreciated by those skilled in the art that the shoe attachment members 44 may alternatively be formed integrally with the shoes 40 or the support member 31. The shoe attachment members 44 may be formed, for example, from wood, aluminum, fiberglass, or a heat tolerant material.

As shown in FIG. 8, the shims 45 are substantially rectangular in shape and have at least one beveled end 46. The beveled ends 46 are formed to have a desired dimension. In the illustrated embodiment, a plurality of the shims 45 are provided, which each have a different thickness and beveled ends of different angular dimensions. The shim 45 may, for example, have a thickness of between about ⅛ inch and ¾ inch, however, other dimensions are possible. The shims 45 may be attached to the bottom surface 34 of the support member 31 by an attachment mechanism 54 that extends through the apertures 32. The shims 45 may be formed, for example, from wood, aluminum, fiberglass, sheet felt, etc.

As shown in FIG. 7, the springs 47 are substantially elongated in shape and are formed to have an external dimension and length. In the illustrated embodiment, a plurality of the springs 47 are provided, which each have a different external dimension and length. A tape 48 may be woven through a first end of the spring 47. A pulling member 57, such as a steel fish tape, may be attached to the tape 48. In the illustrated embodiment, the pulling member 57 is fed through the spring 47 such that the pulling member 57 extends from the second end of the spring 47. Alternatively, the pulling member 57 may be directly attached to the first end of the spring 47. It will be appreciated by those skilled in the art that structures other than springs 47 may also be provided.

As shown in FIG. 7, the heating device 59 is substantially rectangular in shape and has a length substantially corresponding to the width of the support member 31. The heating device 59 is provided with a plurality of radiation elements 60 that radiate heat toward a heat emitting surface of the heating device 59. The radiation elements 60 may be, for example, a plurality of 500 Watt halogen heat strip bulbs. It will be appreciated by those skilled in the art, however, that the wattage of the halogen heat strip bulbs may vary depending of the desired speed of heating. The radiation elements 60 may also be individually controlled. A metal guard (not shown) may be provided between the radiation elements 60 and the heat emitting surface of the heating device 59. The heating device 59 may be any of a variety of conventional heating devices that is portable and is capable of radiating heat.

As shown in FIG. 8, the pre-heating device 50 is mounted to the bottom surface 34 of the conduit receiving end 38 of the support member 31. The pre-heating device 50 includes an elongated heating strip or contact heater 51 and an electrical box 52. The heating strip 51 extends substantially the width of the support member 31 and is mounted directly beneath the conduit holder 35 and in contact with the support member 31, which prevents the support member 31 from warping when the support member 31 is heated. A bracket 61 may be mounted over the heating strip 51 to prevent sagging of the heating strip 51. The heating strip 51 may be, for example, a 300 Wattflat coil operating at about 175-190 degrees Fahrenheit, which may or may not be individually controlled by a contact thermostat 58. The heating strip 51 may be, for example, a CHROMALOX strip heater. The pre-heating device 50 may be any of a variety of conventional heating devices that is capable of radiating heat.

A method of bending the conduit 21 using the portable conduit bending frame assembly 30 according to the second embodiment of the invention will now be described with reference to FIGS. 9-12.

Figure 9:
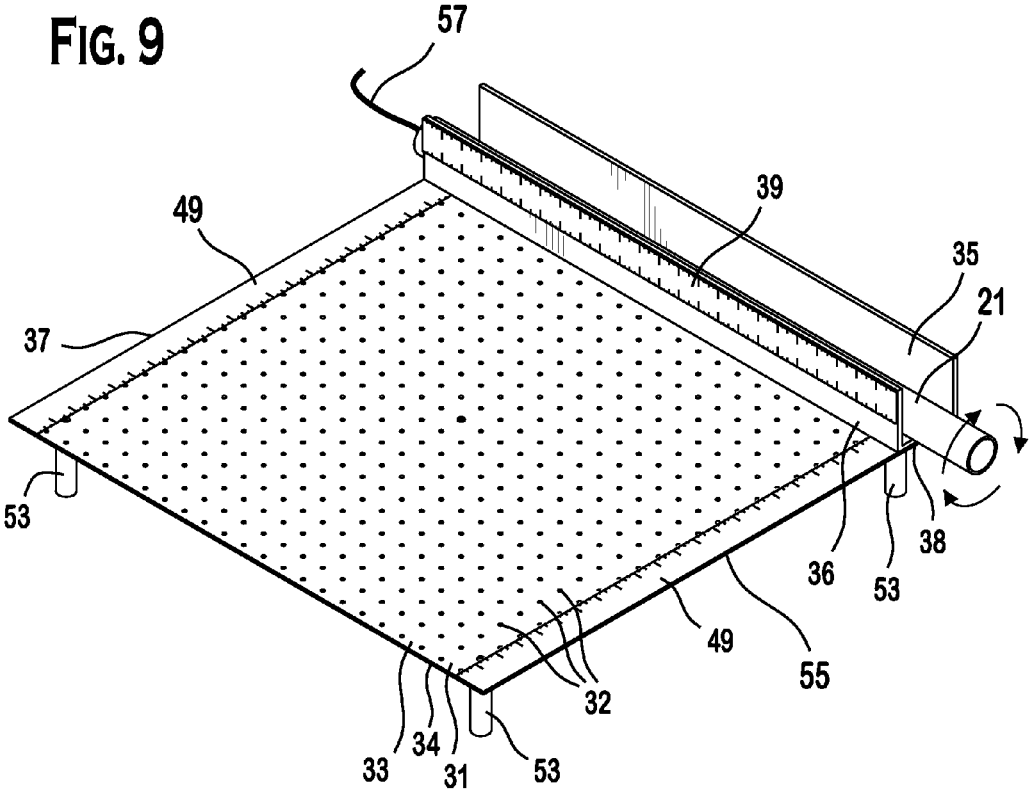
FIG. 9 is a perspective view of a first step in a method of bending a conduit using the portable conduit bending frame assembly of FIG. 7.
Figure 10:
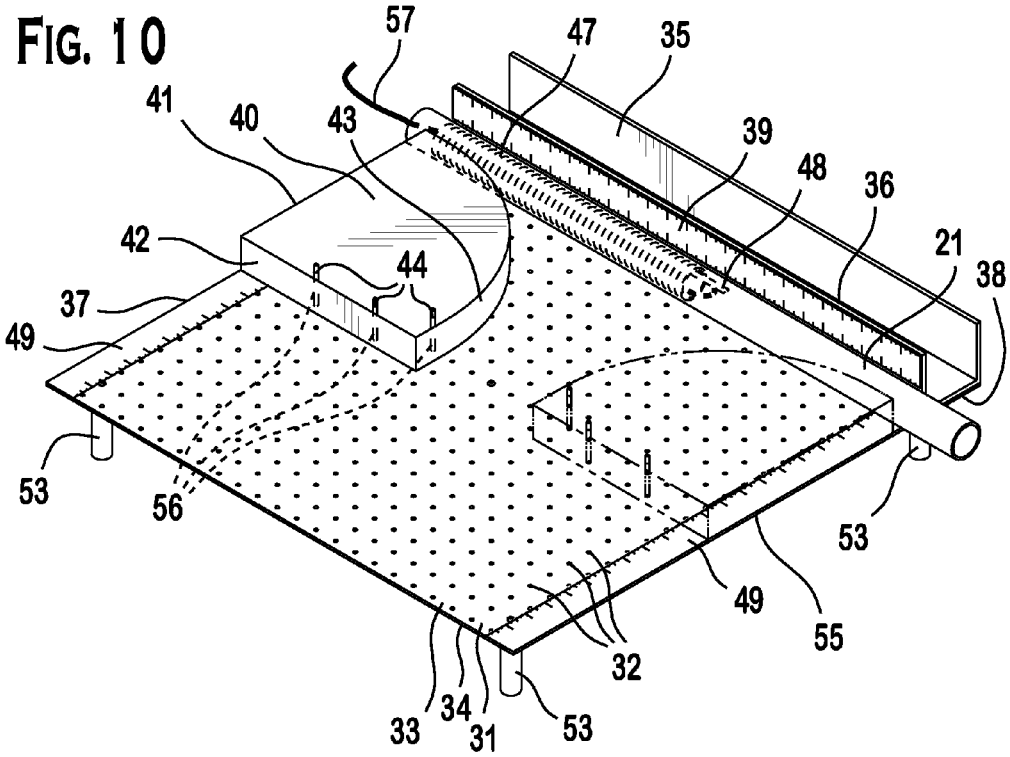
FIG. 10 is a perspective view of a second step in the method of bending the conduit using the portable conduit bending frame assembly of FIG. 7.

As shown in FIGS. 9-10, one of the springs 47 is inserted into the conduit 21 such that the pulling member 57 protrudes from an end of the conduit 21 opposite from the tape 48. A lubricant (not shown), such as liquid soap or a non-stick spray, may be applied to the spring 47 and/or the conduit 21 before insertion of the spring 47 into the conduit 21. The external dimension and length of the spring 47 substantially corresponds to an internal dimension and length of the conduit 21. The conduit 21 is positioned on the conduit receiving end 38 of the support member 31 inside the conduit holder 35 such that the conduit 21 extends in the direction of length of the support member 31. The heating strip 51 of the pre-heating device 50 applies heat to the conduit 21 to pre-heat the conduit 21. The pre-heating device 50 is particularly useful in cold environments to pre-heat the conduit 21 prior to heating with the heating device 59. As the conduit 21 is pre-heated, the conduit 21 may be periodically rotated in a direction of the arrows shown in FIG. 9. Because the spring 47 is provided inside the conduit 21, the spring 47, which conducts heat, contributes to heating the conduit 21. When it is time to form or bend the conduit 21, the pre-heated conduit 21 is removed from the holder 35 of the support member 31 and is positioned against the support surface 36 of the holder 35 such that the conduit 21 extends in the direction of length of the support member 31, as shown in FIG. 10.

Similar to the heating device 20 of the first embodiment shown in FIG. 2, the heat emitting surface of the heating device 59 is positioned proximate the conduit 21 such that the radiation elements 60 radiate heat toward the conduit 21. The metal guard (not shown) of the heating device 59 may optionally be positioned such that the metal guard (not shown) is in contact with the conduit 21. As the conduit 21 is heated, the conduit 21 is periodically rotated in a direction of the arrows shown in FIG. 2 until the conduit 21 is heated to a temperature where it is substantially rubbery and/or capable of being bent with no or minimal resistance. Because the spring 47 is provided inside the conduit 21, the spring 47, which conducts heat, contributes to heating the conduit 21. Once the conduit 21 has been heated, the heating device 59 is removed from the support member 31. It will be appreciated by those skilled in the art that the pre-heating device 50 may alternatively be used to heat the conduit 21 to a temperature where it is substantially rubbery and/or capable of being bent with no or minimal resistance if so configured without the assistance of the heating device 59.

As shown in FIG. 10, at least one of the shoes 40 is attached to the support member 31. The shoe attachment members 44 are inserted into a plurality of the apertures 32 of the support member 31. The shoe 40 is attached to the support member 31 by aligning the first alignment surface 41 of the shoe 40 substantially parallel to the alignment end 37 of the support member 31 such that the conduit 21 is sandwiched between the conduit bending surface 43 of the shoe 40 and the support surface 36 of the holder 35. Alternatively, the shoe 40 may be attached to the support member 31 by aligning the first alignment surface 41 of the shoe 40 substantially parallel to the second alignment end 55 of the support member 31 such that the conduit 21 is sandwiched between the conduit bending surface 43 of the shoe 40 and the support surface 36 of the holder 35, as shown in phantom in FIG. 10. The shoe attachment members 44 are received in the shoe attachment member receiving openings 56 of the shoe 40 to fix the shoe 40 relative to the support member 31.

Figure 11:
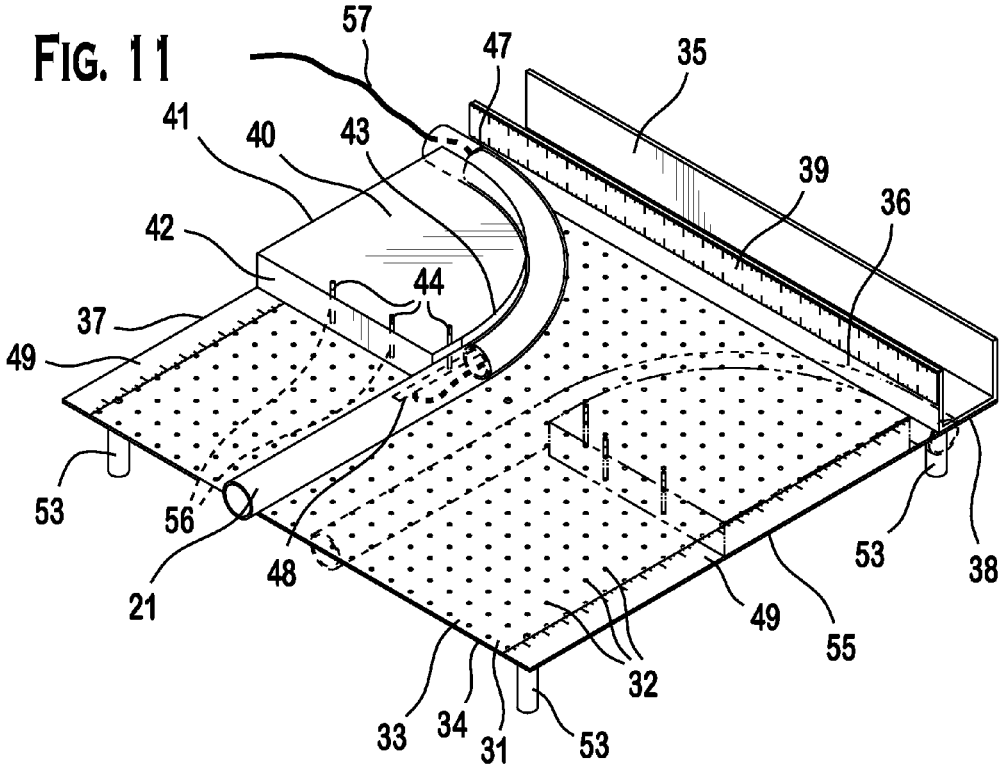
FIG. 11 is a perspective view of a third step in the method of bending the conduit using the portable conduit bending frame assembly of FIG. 7.

As shown in FIG. 11, an end of the conduit 21 positioned farthest from the shoe 40 is pulled away from the support surface 36 such that the conduit 21 is bent about the conduit bending surface 43. The conduit 21 is bent until the conduit 21 concentrically embraces the substantially arcuate configuration of the conduit bending surface 43 of the shoe 40. Because the spring 47 is provided inside the conduit 21, the spring 47 prevents the internal dimension of the conduit 21 from constricting or deforming when the conduit 21 is bent about the conduit bending surface 43 of the shoe 40. Once the conduit 21 is bent to the desired configuration, the conduit 21 is allowed to cool and is then removed from the support member 31.

The spring 47 is removed from the conduit 21 by pulling on the pulling member 57 protruding from the end of the conduit 21. Because the tape 48 is attached to the first end of the spring 47 and the pulling member 57, which is attached to the tape 48, extends from the second end of the spring 47, the spring 47 is prevented from stretching when the spring 47 is pulled from the conduit 21.

Figure 12:
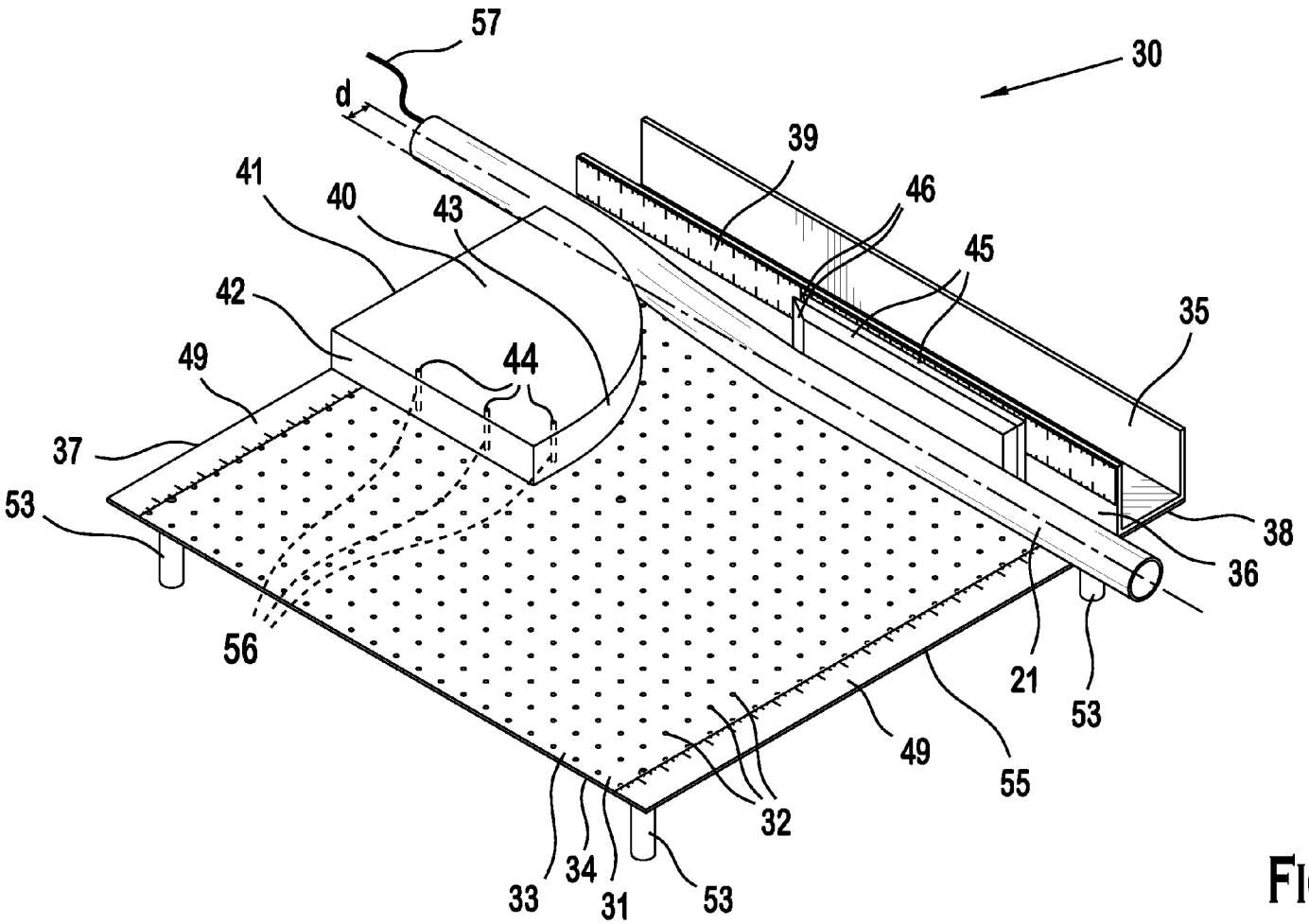
FIG. 12 is a perspective view of a second method of bending the conduit using the portable conduit bending frame assembly of FIG. 7.

FIG. 12 shows a second method of bending the conduit 21. As shown in FIG. 12, after the conduit 21 is heated to a temperature where it is substantially rubbery and/or capable of being bent with no or minimal resistance, at least one of the shims 45 may be positioned substantially parallel to and against the support surface 36 of the holder 35 such that the beveled edges 46 extend in a direction of a desired offset d in the conduit 21. In the illustrated embodiment two of the shims 45 are positioned substantially parallel to and against the support surface 36 of the holder 35. The conduit 21 is removed from the holder 35 of the support member 31 and is positioned against the support surface 36 of the holder 35 such that the conduit 21 extends in the direction of width of the support member 31 and is positioned against the shims 45.

The shoe 40 is attached to the support member 31 by aligning the first alignment surface 41 of the shoe 40 substantially parallel to the first alignment end 37 of the support member 31 such that the conduit 21 is sandwiched between the conduit bending surface 43 of the shoe 40 and the support surface 36 of the holder 35. The shoe attachment members 44 are received in the shoe attachment member receiving openings 56 of the shoe 40 to fix the shoe 40 relative to the support member 31. As a result of the conduit 21 being partially bent about the conduit bending surface 43 and engaging with the beveled edges 46 of the shims 45, the offset d is formed in the conduit 21.

Figure 13:
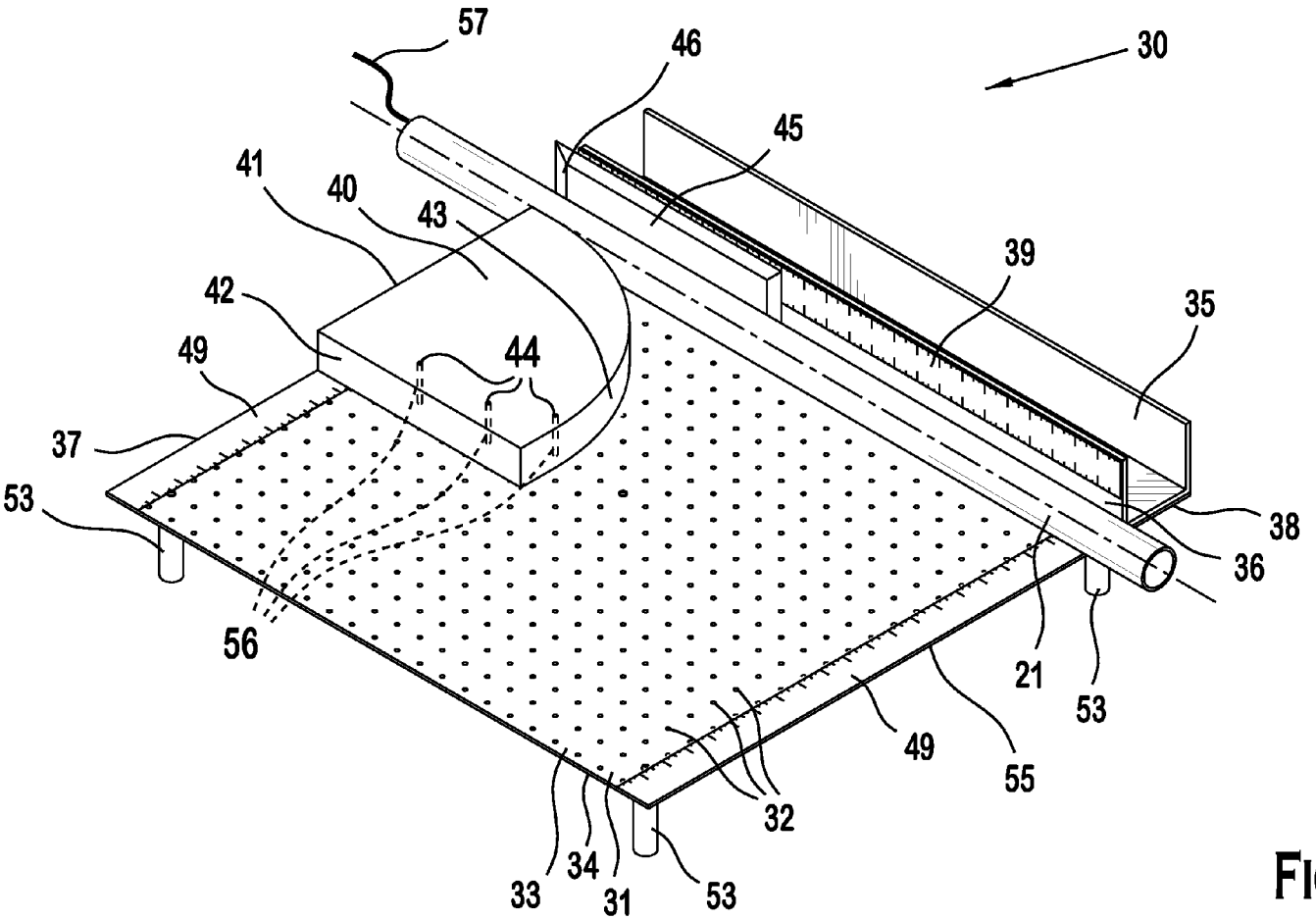
FIG. 13 is a perspective view of a third method of bending the conduit using the portable conduit bending frame assembly of FIG. 7.

FIG. 13 shows a third method of bending the conduit 21. As shown in FIG. 13, at least one of the shims 45 may be positioned against the support surface 36 and substantially above the shoe 40. The conduit 21 is positioned between the conduit bending surface 43 of the shoe 40 and the shim 45. The conduit 21 is then bent to form a bend in the conduit 21 when the shoe 40 provided to bend the conduit 21 is configured for a conduit having a larger diameter than the diameter of the conduit 21 desired to be bent. As a result, each of the shoes 40 can be used to bend the conduits 21 regardless of their diameters.

Although the conduit 21 is only illustrated as being formed with a single bend or offset d, it will be appreciated by those skilled in the art that the conduit 21 may be formed to have a plurality of bends and/or offsets d. Additionally, because the first conduit measuring device 39 may have, for example, units of measurement that measure from the first alignment end 37 to the second alignment end 55 and from the second alignment end 55 to the first alignment end 37, the conduit 21 may be easily arranged on the support member 31 to accommodate the direction of the desired subsequent bends and/or offsets d in view of the previously made bends and/or offsets d in the conduit 21.

The portable conduit bending frame assemblies 1, 30 according to the first and second embodiments of the invention are therefore easy to transport and operate and can economically heat and form or bend the conduit 21 to a desired configuration to obtain a conduit with a desired configuration without the use of couplings.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A portable conduit bending frame assembly, comprising:

a support member having a first alignment end, a second alignment end, and a stationary conduit support surface fixed thereto, the conduit support surface extending substantially perpendicular to a top surface of the support member;

a shoe attached to the top surface of the support member, the shoe having a first alignment surface extending substantially perpendicular to a second alignment surface and a conduit bending surface extending between the first and second alignment surfaces that has a substantially arcuate configuration, the conduit bending surface facing the conduit support surface, and the shoe being movable such that its first alignment surface can be aligned with either alignment end of the support member; and a heating device arranged proximate the conduit support surface for heating a conduit prior to bending the conduit at least partially about the conduit bending surface.

2. The assembly of claim 1, wherein the shoe is detachable from the support member.

3. The assembly of claim 2, wherein the support member includes a plurality of apertures that receive shoe attachment members that attach the shoe to the support member.

4. The assembly of claim 1, further comprising a pre-heating device.

5. The assembly of claim 4, wherein the pre-heating device is mounted to a bottom surface of the support member.

6. The assembly of claim 5, wherein the conduit support surface is a side of a substantially U-shaped conduit holder and the pre-heating device includes a heating strip mounted underneath the conduit holder.

7. The assembly of claim 1, wherein the conduit support surface is a side of a storage container.

8. The assembly of claim 1, further comprising at least one shim having a beveled edge for forming an offset in the conduit, the shim positioned substantially against the conduit support surface.

9. The portable conduit bending frame assembly according to claim 1, wherein the stationary conduit support surface extends along a width of the support member.

10. The portable conduit bending frame assembly according to claim 1, wherein the width of the support member is a conduit receiving end.

11. The portable conduit bending frame assembly according to claim 1, wherein the stationary conduit support surface is a flat surface.

12. The portable conduit bending frame assembly according to claim 1, further comprising springs that are substantially elongated in shape and are formed to have an external dimension and length.

13. The portable conduit bending frame assembly according to claim 12, further comprising a tape woven through a first end of the spring with a pulling member attached to the tape.

14. A portable conduit bending frame assembly, comprising:

a support member having a first alignment end, a second alignment end, and a first conduit measuring device that extends an approximate width of the support member, the support member having a flat conduit support surface fixed thereto and extending substantially perpendicular to a top surface of the support member;

a shoe having a first alignment surface extending substantially perpendicular to a second alignment surface and a conduit bending surface extending between the first and second alignment surfaces that has a substantially arcuate configuration, the conduit bending surface facing the conduit support surface, and the shoe being removably attachable to the top surface such that its first alignment surface can be aligned parallel with either alignment end of the support member; and a heating device arranged proximate the conduit support surface for heating a conduit prior to bending the conduit at least partially about the conduit bending surface.

15. The portable conduit bending frame assembly according to claim 14, wherein the first conduit measuring device extends along a surface of the conduit support surface.

16. The portable conduit bending frame assembly according to claim 14, further comprising second conduit measuring devices that extend substantially perpendicular to the first conduit measuring device along the length of the support member.

17. A portable conduit bending frame assembly, comprising:

a support member having a first alignment end, a second alignment end, and a first conduit measuring device that extends an approximate width of the support member and a second conduit measuring device that extends substantially perpendicular to the first conduit measuring device along a single length of the support member, the support member having a conduit support surface fixed thereto and extending substantially perpendicular to a top surface of the support member;

a shoe attached to the top surface of the support member, the shoe having a first alignment surface extending substantially perpendicular to a second alignment surface and a conduit bending surface extending between the first and second alignment surfaces that has a substantially arcuate configuration, the conduit bending surface facing the conduit support surface, the first alignment surface being alignable with either alignment end; and a heating device arranged proximate the conduit support surface for heating a conduit prior to bending the conduit at least partially about the conduit bending surface.

18. The portable conduit bending frame assembly according to claim 17, wherein the first conduit measuring device extends along a surface of the conduit support surface.

* * * * *